US007591300B2

(12) United States Patent
Hohenbichler et al.

(10) Patent No.: US 7,591,300 B2
(45) Date of Patent: Sep. 22, 2009

(54) PROCESS FOR PRODUCING A CAST METAL STRIP, AND TWO-ROLL CASTING DEVICE USED FOR THIS PROCESS

(75) Inventors: Gerald Hohenbichler, Kronstorf (AT); Gerald Eckerstorfer, Linz (AT); Markus Brummayer, Aschach (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 270 days.

(21) Appl. No.: 10/557,319

(22) PCT Filed: May 10, 2004

(86) PCT No.: PCT/EP2004/004947

§ 371 (c)(1),
(2), (4) Date: Nov. 18, 2005

(87) PCT Pub. No.: WO2004/101196

PCT Pub. Date: Nov. 25, 2004

(65) Prior Publication Data

US 2006/0248706 A1 Nov. 9, 2006

(30) Foreign Application Priority Data

May 19, 2003 (AT) ..... A 772/2003

(51) Int. Cl.
*B22D 11/06* (2006.01)

(52) U.S. Cl. ..... 164/480; 164/428

(58) Field of Classification Search ..... 164/428–429, 164/479–480

See application file for complete search history.

(56) References Cited

U.S. PATENT DOCUMENTS 4,751,957 A * 6/1988 Vaught ..... 164/463

(Continued)

FOREIGN PATENT DOCUMENTS

DE 4321478 1/1994

(Continued)

OTHER PUBLICATIONS

International Search Report for PCT/EP2004/004947 dated Jul. 27, 2004.

*Primary Examiner*—Kuang Lin
(74) *Attorney, Agent, or Firm*—Ostrolenk, Faber, Gerb & Soffen, LLP

(57) ABSTRACT

The invention relates to a method for producing a cast metal strip using a twin roll casting installation comprising two casting rolls and two lateral plates that together define a molten metal chamber and a casting gap. Molten metal is introduced in to the molten metal chamber and forms the molten metal chamber a molten metal bath with a bath surface that is open to the top. A cast metal strip is conveyed from the molten metal chamber and through the casting gap. A delimiting surface area for collecting particles that are foreign to the molten metal is produced on the surface of the bath under the effect of at least one gas jet. The aim of the invention is to substantially avoid the introduction of particles that are foreign to the molten metal into the surface or into the near-surface zone of the cast strip. For this purpose, the at least one gas jet is directed together with the casting roll onto the bath surface at a distance of the gas jet axis to the contact line of the bath surface.

39 Claims, 7 Drawing Sheets

U.S. PATENT DOCUMENTS

| | | | | |
|---|---|---|---|---|
| 6,868,895 | B2 * | 3/2005 | Izu et al. | 164/480 |
| 6,923,245 | B2 | 8/2005 | Marti et al. | 164/480 |

FOREIGN PATENT DOCUMENTS

| | | | |
|---|---|---|---|
| JP | 60170562 | A * | 9/1985 |
| JP | 2-207946 | | 8/1990 |
| JP | 04197560 | | 7/1992 |
| JP | 05228585 | | 9/1993 |
| JP | 2001-314946 | | 11/2001 |
| WO | WO 03/049888 | | 6/2003 |

* cited by examiner

Fig.8
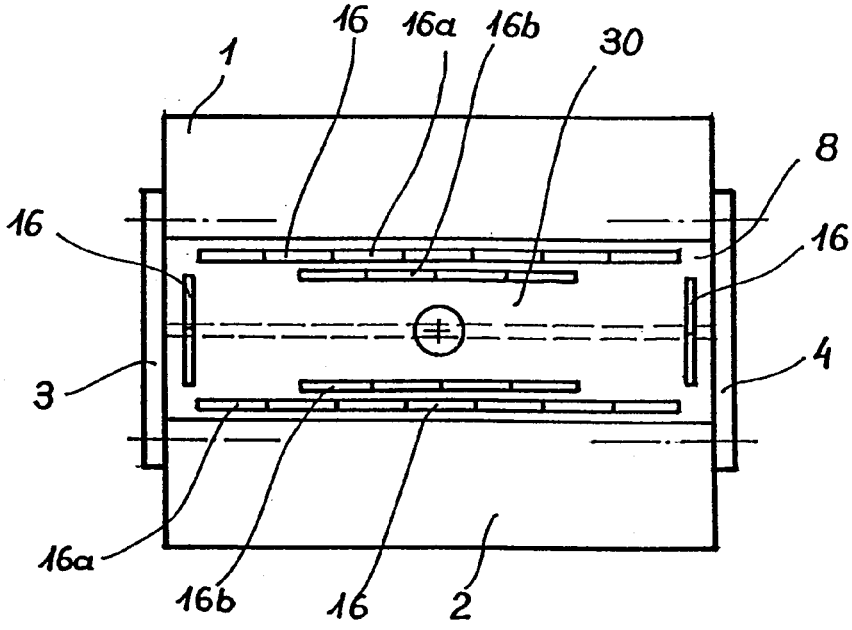
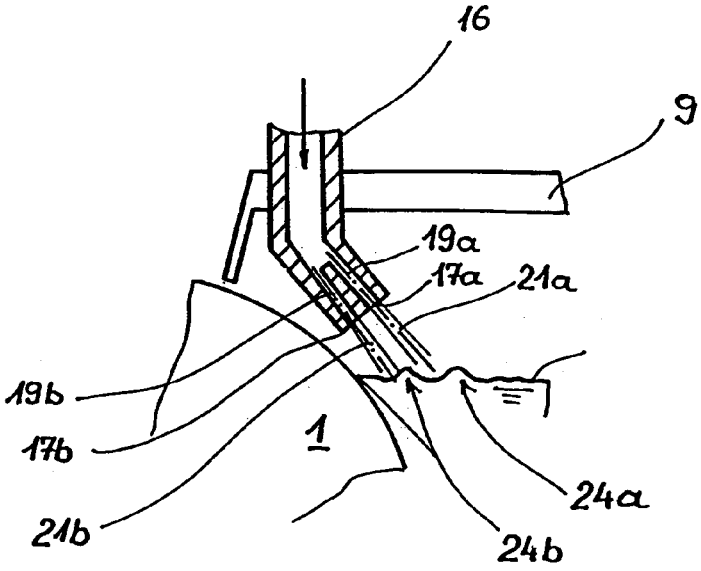
Fig.9

PROCESS FOR PRODUCING A CAST METAL STRIP, AND TWO-ROLL CASTING DEVICE USED FOR THIS PROCESS

CROSS REFERENCE TO RELATED APPLICATION

The present application is a 35 U.S.C. §§ 371 national phase conversion of PCT/EP2004/004947, filed 10 May 2004, which claims priority of German Application No. A 772/2003, filed 19 May 2003. The PCT International Application was published in the German language.

BACKGROUND OF THE INVENTION

The invention relates to a process for producing a cast metal strip using two casting rolls and two side plates, which together form a melt space and a casting gap, metal melt being fed into the melt space and in the melt space forming a melt bath with a bath surface which is open at the top, and a cast metal strip being delivered out of the melt space through the casting gap, and a delimited surface region for the collection of particles which are foreign to the melt being formed on the bath surface under the action of at least one gas jet, and to a two-roll casting device used for this process.

The invention preferably relates to a casting process for producing a continuously cast steel strip with a strip thickness of between 0.5 mm and 10 mm using a two-roll casting installation, with the cast steel strip being removed substantially vertically downward.

A two-roll casting device with a vertically delivered metal strip is generally known and comprises, as is diagrammatically illustrated in FIGS. 1 and 2, two driven, oppositely rotating casting rolls 1, 2 and two sides plates 3, 4, which are preferably placed against the end sides of the casting rolls and thereby form a melt space 5 for receiving metal melt introduced through a submerged casting nozzle 6. The two axes of rotation of the casting rolls lie in a horizontal plane and are arranged parallel to and at a distance from one another, so that a casting gap 7 is formed between the casting rolls; the longitudinal extent of this casting gap 7 is delimited by the side plates, and therefore the casting gap 7 has a cross section which corresponds to the cross section of the desired cast strip. With continuous supply of metal melt into the melt space, a melt bath with a bath surface 8 that is open at the top is formed therein. Above the bath surface, the melt space is delimited by a covering hood 9, which bears, either so as to form a seal or leaving clear a gap, against the casting rolls and side plates, in order to substantially prevent the access of external air. At the bottom, the melt space opens out into the casting gap, from which the metal strip emerges. When the casting rolls are rotating, starting from the contact lines 10, 11 between the bath surface and the cooled casting rolls, two strand shells 12 are formed on the lateral surfaces of the casting rolls where they enter the melt bath, the strand shells becoming continuously thicker and ultimately being combined in the casting gap to form the metal strip 13.

With a continuous supply of metal melt into the melt bath through the submerged casting nozzle, which causes movement in the melt bath, nonmetallic particles which are foreign to the melt are entrained. These particles float to the surface of the bath, where they agglomerate, together with particles which are foreign to the melt and were generated in the mold melt bath by chemical reaction with refractory material or by reoxidation, and are incorporated in the strand shells predominantly at the contact line with the casting rolls directly at the lateral surface of the casting rolls, forming inclusions and seeds for macrocracks and microcracks at the surface and in the region close to the surface of the cast metal strip.

A two-roll casting installation and a casting process for casting a metal melt in accordance with the prior art described is known, for example, from JP-A 2001-314946, WO 02/083343 and JP-A 2-207946.

To keep particles which are foreign to the melt away from the contact line between the casting-roll surface and the bath level surface, it is proposed in JP-A 2001-314946 that gas jets be applied in the region of this contact line, causing the particles which are foreign to the melt to drift away toward the center of the melt pool. The gas jets cover part of the casting roll surface and an edge region of the bath level surface, but bath fluctuations and temperature fluctuations which influence the strand shell growth occur at the casting roll surface in a sensitive area depending on the intensity and temperature of the gas jets. Unfortunately, substantially uniform starting conditions for the formation of the strand shells in this region are particularly important for the end product.

According to WO 02/083343, drifting of particles which are foreign to the melt and have been entrained into the melt bath toward the contact line between the metal bath and the lateral surfaces of the casting rolls is avoided during casting operation by means of shields which are obliquely immersed in the metal bath and the lower edges of which are positioned below the level of the outlet openings of the submerged casting nozzle. The intention of this is to additionally create a melt pool in the melt space, in which the nonmetallic particles can be separated off. The metal strip which is produced continuously using the two-roll casting device is wound into coils, and at the end of the winding operation of each individual coil, the shields are removed from the metal bath and the particles which have been separated out at the surface of the bath are blown toward at least one of the casting roll surfaces using gas nozzles and in this way discharged together with a short piece of the metal strip. The main drawback of this process is that each cast coil produces a piece of scrap, which interrupts the continuous production process and increases the scrap rate of production. Furthermore, metal melt accumulates on the shields and solidifies each time the shield is raised. If the shield consists of refractory material, eroded particles of the refractory material are additionally introduced into the melt, or chemical reactions occur between the liquid steel and the refractory material, which produce additional impurities.

JP-A 2-207946 has disclosed a two-roll casting device in which the foreign particles floating on the bath surface are removed by being continuously scooped out using rotating cup mechanisms. Since these devices at the bath surface have to work at the melting point of the metal, there is likely to be a high number of operating faults in these mechanical devices. In addition, in the case of a steel bath, the bath surface has to be protected from contact with atmospheric oxygen, and consequently it is not feasible to use scoop devices of this type under these conditions.

SUMMARY OF THE INVENTION

Therefore, it is an object of the present invention to avoid the drawbacks of the prior art described and to propose a process for producing a cast metal strip and a two-roll casting device, in which the introduction of particles which are foreign to the melt at or into the surface or into the region close to the surface of the cast strip is substantially avoided, a contact line between the bath surface and the casting roll lateral surface which is substantially free of disruption and is delimited from the formation of any waves at the bath surface is achieved and at the same time contact of oxygen with the bath surface is as far as possible avoided.

Working on the basis of a process of the type described in the introduction, this object is achieved by virtue of the fact that the at least one gas jet is directed on to the bath surface with the gas jet axis at a distance from the contact line between the bath surface and the casting roll.

In this case, the at least one gas jet is shaped in such a way that no gaps through which particles which are foreign to the melt can escape remain along the delimited surface region. In general, the delimited surface region may be formed by a gas jet which forms a closed ring with any desired outer contour or by a plurality of successive gas jets. At the same time, in particular in the case of metal melts which have a high tendency to oxidation, such as steel, an inert or reducing shielding gas atmosphere is produced and maintained above the metal bath and within a melt space which is optimally closed off with respect to the ingress of external air, which virtually rules out reoxidation of the metal melt.

The at least one gas jet is directed directly on to the bath surface. This produces a calm edge strip, which remains substantially unaffected by the formation of waves at the bath surface, between the region of contact between the gas jet and the bath surface and the casting rolls and/or side plates which delimit the melt space. This measure greatly assists with a constant, uniform and undisturbed formation of strand shells at the lateral surfaces of the casting rolls which rotate in accordance with the casting speed, if the casting roll surfaces also run and function in an optimally stable and homogenously uniform way.

In this context, it is particularly expedient if the at least one gas jet is directed on to the bath surface at an angle from 25° to 145°, preferably at an angle of from 35° to 90°, based on a horizontal plane. In this case, the bath surface substantially corresponds to this horizontal plane.

Each gas jet is assigned a gas jet axis. Preferably, the at least one gas jet is directed on to the bath surface with the gas jet axis at a distance from the contact line between the bath surface and the casting roll and/or from the contact line between the bath surface and the side plate. This distance is preferably constant and in a range between 10 mm and 50 mm, measured on the bath surface.

Since the side plates, unlike the rotating casting rolls, are substantially stationary, the at least one gas jet can be directed on to the side plate surface at a distance from the contact line between the bath surface and the side plate, and at least a part-stream of the gas jet is effectively diverted on to the bath surface.

The gas jet or gas jets are preferably in the form of fan jets and emerge from a correspondingly shaped nozzle. It is expedient for a multiplicity of nozzles to be arranged in succession, so as to produce a continuous narrow gas jet, similar to that used in a gas meter.

To form a delimited surface region of any desired shape on the bath surface, the at least one gas jet is in the form of a partially curved fan jet.

Once it emerges from the gas jet nozzle, the gas jet diverges with an opening angle of between 10° and 35° in the direction of flow. For the uniform and stable formation of a strand shell, it is necessary for all of the diverging gas jet to strike the bath surface, rather than being partially directed on to the lateral surface of the casting roll. At the side plates, which may execute an oscillating movement, direct contact between the gas jet and the side plate is perfectly permissible, since the disadvantageous effects encountered at the lateral surfaces of the casting rolls do not occur here.

According to a preferred embodiment, between the two side plates, if appropriate leaving clear a distance with respect to the side plates, the at least one gas jet acts on the bath surface parallel or obliquely, without interruption, to the contact line between the bath surface and the casting roll. This ensures that the casting roll surface is continuously shielded from contact with particles which are foreign to the melt. Continuous discharge of the particles toward the side plates and therefore into the edge zone of the cast metal strip is possible and also desirable, since the cast metal strip, at least before it is wound in a downstream coiler, passes through a trimming station, which is not necessarily arranged within the actual two-roll casting installation, and therefore a controlled increase in the level of nonmetallic inclusions in this region does not cause any additional scrap material. Arranging the gas jet so as to run obliquely with respect to the contact line between the bath surface and the casting roll additionally promotes continuous discharge of particles which are foreign to the melt toward the side plates. Furthermore, leaving clear a distance with respect to the side plates avoids local cooling of a spatially restricted zone at the side plates by the gas jets.

Equally, between the two casting rolls, if appropriate leaving clear a distance with respect to the casting rolls, the at least one gas jet acts on the bath surface parallel, without interruption, to the contact line between the bath surface and the side plate. As a result, if no increase in particles foreign to the melt is desired even at the edges of the metal strip while casting operation is ongoing, suitable shielding is achieved. Leaving clear a distance with respect to the casting rolls avoids local cooling on the casting roll lateral surface along a circumferential strip and therefore different levels of strand shell growth along the contact line between the casting roll lateral surface and the bath surface.

A further improvement to the restricting of the particles foreign to the melt is achieved if at least in sections at least two gas jets act on the bath surface at a distance from one another. This measure improves the surface quality of the strip in particular along the contact line between the casting roll lateral surface and the bath surface. It is preferable for the two gas jets to be arranged equidistantly with respect to one another.

Components of the two-roll casting device which form the melt space or are arranged directly within it can be included when forming the delimited surface region with gas jets. In this case, the delimited surface region is formed in sections by at least one gas jet and in sections by sections of the side plates or the casting rolls or a submerged casting nozzle or other internal fittings.

It is preferable for the at least one gas jet which strikes the metal bath at an angle to form a gap-free bow wave, i.e. a swell at the bath surface which extends parallel to the direction of extent of a fan jet and encloses the delimited surface region at least in sections. The bow wave may be continuous and in this way form this delimited surface region, or may form a delimited surface region in combination with components of the two-roll casting device, such as sections of the side plates or of the casting rolls or of a submerged casting nozzle or of other internal fittings.

The bow wave formed by the gas jets is held substantially constant at a height of from 0.05 mm to 10 mm, preferably from 0.1 mm to 3 mm, above the normal level of the bath surface. This creates a collection tank for the particles which are foreign to the melt, and the particles are held there until they are discharged in a controlled way or until casting ends automatically.

An inert or reducing gas is used to form the gas jet, to ensure that there is no reoxidation of the metal melt at the bath surface in this region. Preferred gases which can be used include argon, nitrogen, $N+H_2$ or mixtures of at least two of these gases.

In the starting phase of a casting process, the process according to the invention should only be deployed when an operating bath level has been reached and therefore the metal melt has been substantially stabilized and calmed in the melt space and in particular at the bath surface. Therefore, during the starting phase of the casting process, the action of at least one gas jet on the bath surface is expediently only switched on 10 sec to 2 min after the introduction of melt into the melt space has commenced (start of casting).

Over a prolonged casting period, particles which are foreign to the melt accumulate within the delimited surface region and have to be removed at least at periodic intervals. This is preferably done during interruptions to production for operation reasons, during which the melt space itself is completely emptied and then the installation is restarted and casting recommenced. If these time intervals are too long, the action of at least one gas jet on the bath surface is interrupted in sections in a time interval in order for accumulated particles which are foreign to the melt to be discharged from a delimited surface region. This is achieved by the action of at least one gas jet on the bath surface being interrupted either along the contact line between the bath surface and at least one of the two casting rolls or along the contact line between the bath surface and at least one of the two side plates, and preferably along the contact line between the bath surface and both side plates. The discharge of particles which are foreign to the melt toward the side walls and therefore into the edge region of the cast metal strip avoids the formation of inclusions close to the surface at the wide sides of the metal strip, and this edge strip with increased levels of inclusions is removed during the trimming of the strip, which takes place within a subsequent process step. The discharging of particles which are foreign to the melt via the contact surface between the casting rolls and the metal melt in the melt space expediently takes place in a time interval immediately after the coil weight of the cast metal strip has been reached.

The invention also proposes a two-roll casting device for producing a cast metal strip of the generic type described in the introduction, having two casting rolls driven in rotation and side plates, which bear against the end sides of the casting rolls, these casting rolls and side plates together forming a melt space for receiving a melt bath with a bath surface, and a casting gap. At least one gas jet nozzle with an outlet opening for a directed gas jet is arranged in the melt space or directed or projecting into the melt space, in such a way that a delimited surface region for collection of particles which are foreign to the melt is formed on the bath surface. A two-roll casting device formed in this way is characterized in that the outlet opening of the gas jet nozzle is directed directly on to the bath surface at a distance from the contact line between the bath surface and the casting roll.

At a distance above the bath surface, the melt space is protected from the ingress of air by a covering hood. The covering hood bears against the side plates and the casting rolls with a contact surface or a seal, or in particular is set at a narrow gap from the casting rolls, in which case shielding gas which is introduced into the melt space escapes through these gaps and in this way prevents external air from entering this melt space. At least the outlet openings of the gas jet nozzles project through the covering hood into the melt space and are preferably secured to the covering hood and oriented.

In general, the orientation of the outlet opening of the gas jet nozzles determines the direction of the emerging gas jet. To this extent, the orientation of the nozzle axis in the outlet cross section of the gas jet nozzle corresponds to the orientation of the gas jet axis of the gas jet in the cross section of the outlet opening. Since the outlet openings of the gas jet nozzle and therefore the defined nozzle axis in the outlet opening of the gas jet nozzle are directed directly on to the bath surface, the drifting of particles which are foreign to the melt into undesirable zones of the bath surface is avoided. Favorable conditions for this are achieved if the distance between the gas jet axis directed on to the bath surface and the contact line between the bath surface and the casting roll is in a range from 10 mm to 50 mm, measured on the bath surface. Favorable conditions likewise result if the outlet opening of the gas jet nozzle or the nozzle axis, in the outlet cross section of the outlet opening, is directed toward the bath surface at an angle of from 25° to 145°, preferably at an angle of from 35° to 90°, based on a horizontal plane. The bath surface in this case forms the horizontal plane.

To produce a very narrow but elongate gas jet, the gas jet nozzle is configured as a fan jet nozzle or slot nozzle with a slot-shaped outlet opening. Arranging a plurality of gas jet nozzles of this type in succession allows a delimited region of any desired shape to be enclosed on the bath surface using gas jets.

It is expedient for the outlet opening of the gas jet nozzle to be directed directly on to the bath surface at a distance from the contact line between the bath surface and the side plate.

A beneficial effect is produced if, between the two side plates, if appropriate leaving clear a distance with respect to the side plates, the outlet opening of the gas jet nozzle is directed on to the bath surface parallel to the contact line between the bath surface and the casting roll.

Excessive local cooling at the side plates under the action of a continuous gas jet is avoided if, between the two casting rolls, if appropriate leaving clear a distance with respect to the casting rolls, the outlet opening of the gas jet nozzle is directed on to the bath surface parallel to the contact line between the bath surface and the side plate. Excessive local cooling at the casting roll surface is avoided if, between the two casting rolls, if appropriate leaving clear a distance with respect to the casting rolls, the outlet opening of the gas jet nozzle is directed on to the bath surface parallel to the contact line between the bath surface and the side plate.

Improved shielding with respect to the particles which are foreign to the melt is achieved if a gas jet nozzle is equipped with two, substantially equidistant, outlet openings for targeted gas jets, or two gas jet nozzles each having one outlet opening are provided, in which case the outlet openings are arranged in such a way that a double-delimited surface region for the collection of particles which are foreign to the melt is formed on the bath surface.

A continuous, delimited region for the collection of particles which are foreign to the melt is achieved if the outlet openings of at least one gas jet nozzle are directed on to the bath surface in such a way that, under the action of gas jets, they form a delimited surface region on the bath surface. However, this is also possible if the outlet openings of at least one gas jet nozzle are directed on to the bath surface in such a way that, together with sections of the casting rolls or of the side plates or of other internals in the melt bath, and under the action of gas jets in sequence, they form a delimited surface region on the bath surface.

Further advantages and features of the present invention will emerge from the following description of non-restricting exemplary embodiments, in which reference is made to the appended figures, in which:

BRIEF DESCRIPTION OF THE DRAWINGS

FIG. 8 shows the arrangement of a delimited surface region on the bath surface with double gas jets, FIG. 9 shows a gas jet nozzle with two outlet openings.

DETAILED DESCRIPTION OF EMBODIMENTS OF THE INVENTION

Figure 1:
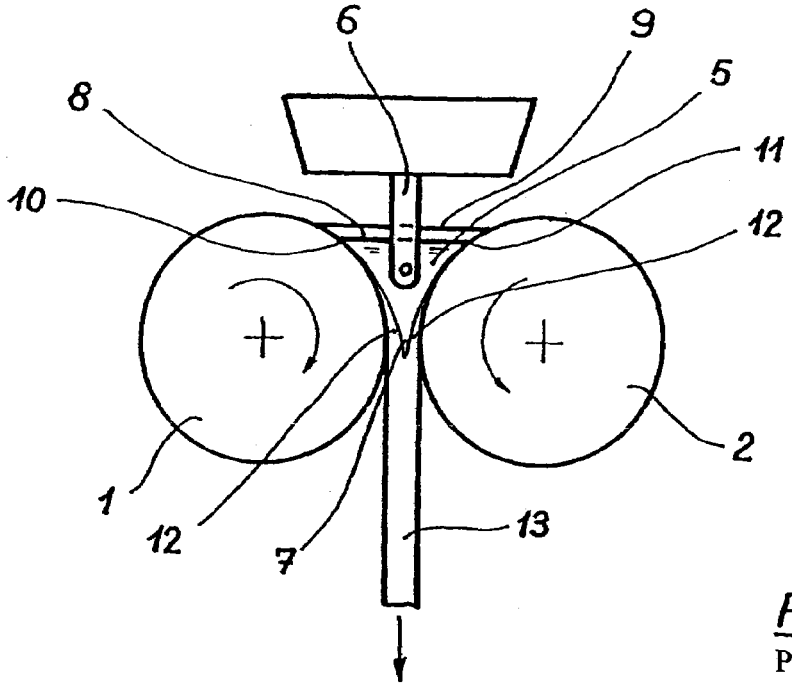
Fig. 1 PRIOR ART
FIG. 1 shows a two-roll casting device according to the prior art in cross section through the casting rolls.
Figure 2:
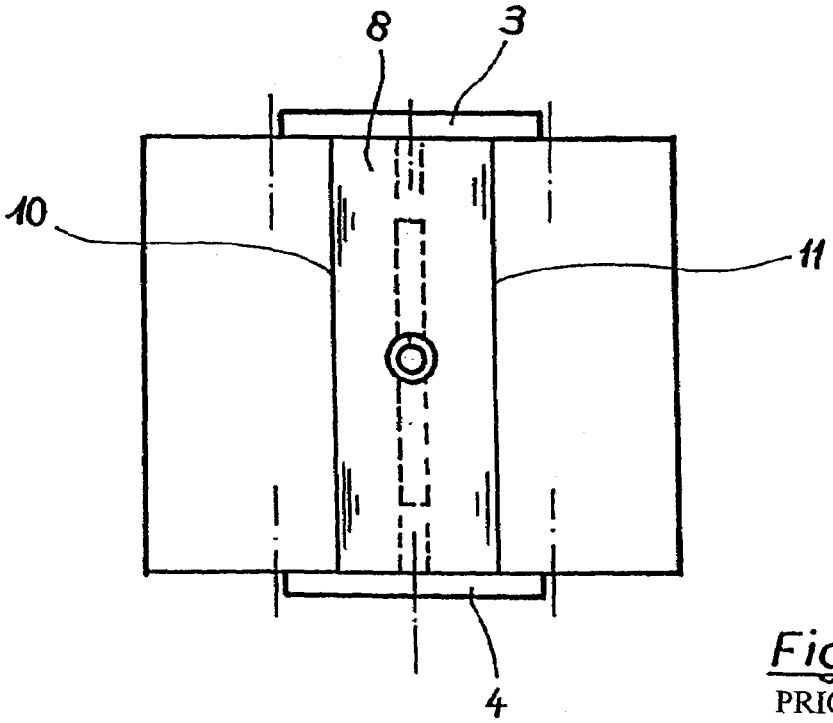
Fig. 2 PRIOR ART
FIG. 2 shows a two-roll casting device according to the prior art in plan view.

The basic structure of a two-roll casting device has already been described in the summary of the prior art with reference to FIGS. 1 and 2. The reference numerals which have already been introduced to certain components in those figures are also applied accordingly for the same components in the text which follows. Two-roll casting devices are used for the continuous production of continuous-cast steel strips.

In particular for stainless steel grades, particularly high demands are imposed on the surface quality of the strips produced, since even minor inclusions of foreign substances, such as slags, metal oxides and the like, at the surface or in the region close to the surface form seed cells for microcracks and macrocracks, with noticeable adverse consequences for the surface condition.

Figure 3:
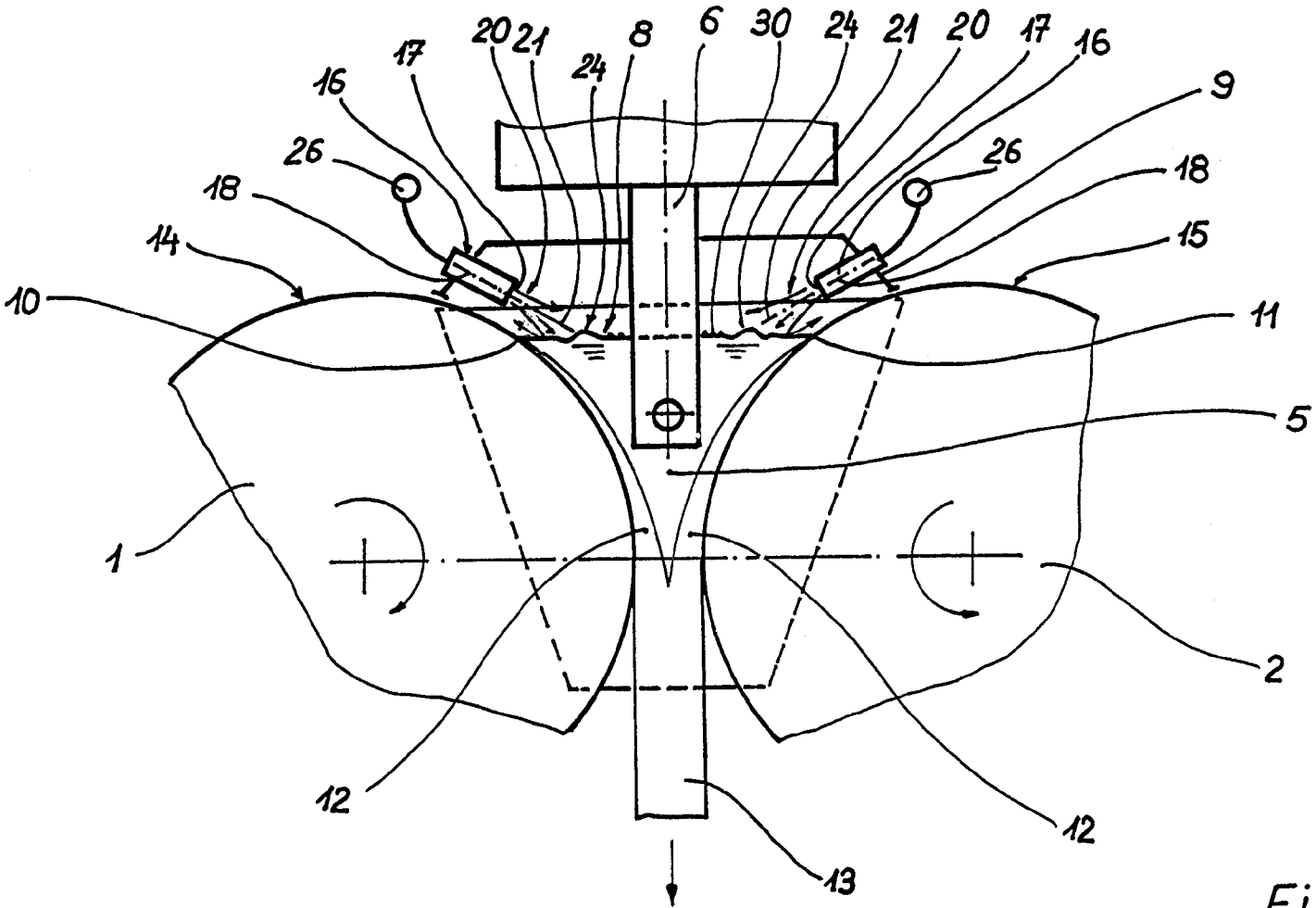
FIG. 3 shows a two-roll casting device having the casting nozzles according to the invention or gas jets directed in accordance with the invention.

The principle on which the process according to the invention is based is illustrated in FIG. 3. A melt space 5, in which there is steel melt which is supplied continuously via a submerged casting nozzle 6, is formed between two casting rolls 1, 2, which rotate in the direction indicated by the arrows, and side plates 3, which bear against the end sides of the casting rolls and only one of which is illustrated in this sectional illustration. The melt bath forms a bath surface 8 which extends between the two casting rolls 1, 2. Starting from the contact lines 10, 11 between the bath surface 8 and the casting roll surfaces 14, 15 of the internally cooled casting rolls 1, 2, strand shells 12 are formed and are fused together in the casting gap 7 to form the metal strip 13.

Gas jet nozzles 16 are arranged at a distance above the bath surface 8, with their outlet openings 17 or their nozzle axes 18 in the outlet cross section of the outlet opening 17 directed obliquely toward the bath surface 8. The gas jets 20 which emerge with the gas jet axes 21 produce a bow wave 24 of a certain height on the bath surface 8. This height also is determined to a significant extent by the flow velocity of the gas jets and the pressure with which they strike the bath surface. Particles which are foreign to the melt and float on the melt bath accumulate between opposite bow waves 24 or within the surface region 30 which is delimited by a bow wave. The gas jet nozzles 16 are connected to supply lines 26, through which they are supplied with an inert or reducing gas. A multiplicity of gas jet nozzles are connected to the supply lines, which preferably form a circular pipeline.

Figure 4:
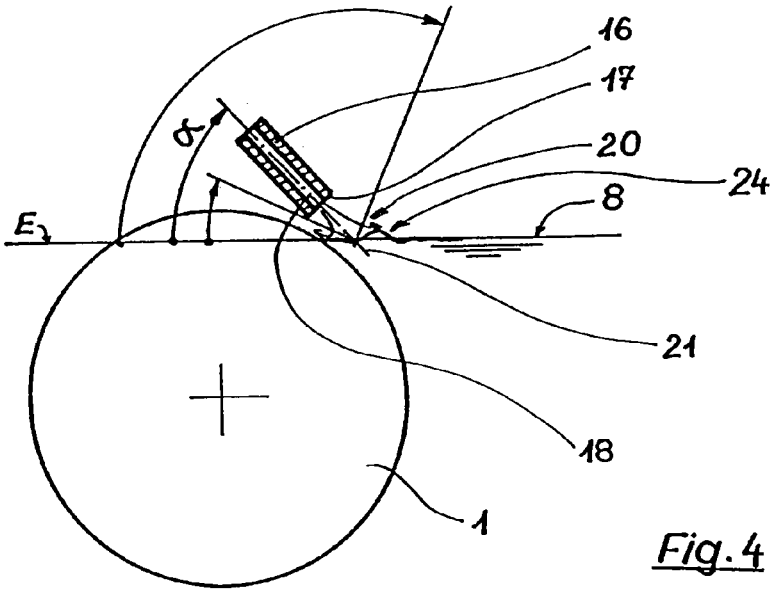
FIG. 4 shows the gas jet nozzle orientation and gas jet orientation on to bath surface according to one embodiment of the invention.

In FIG. 4, the outlet opening 17 or the nozzle axis 18 of the gas jet nozzle 16 is directed on to the bath surface 8, so that the gas jets 20 strike the bath surface directly and produce a bow wave 24. In this case, the outlet opening 17 or the gas jets 20 or the gas jet axes 21 is/are directed toward the bath surface 8, which defines a horizontal plane E at an angle $\alpha$ which may be between 25° and 145°. The angle $\alpha$ is in this case determined from the casting roll side, as illustrated in FIG. 4.

Figure 5:
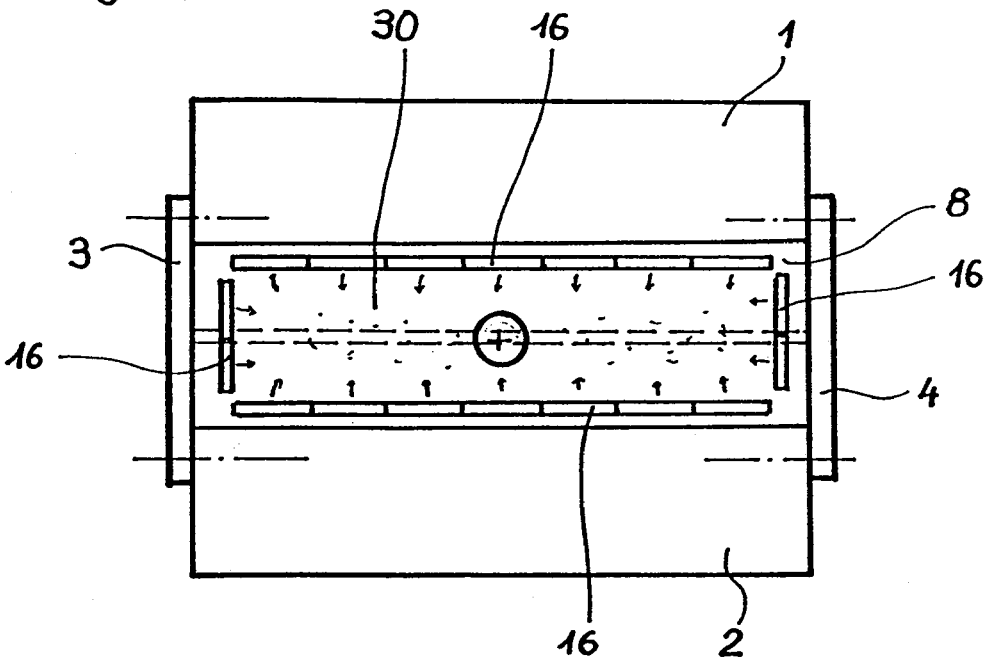
FIG. 5 shows the formation of a delimited surface region on the bath surface according to one embodiment of the invention.

A multiplicity of gas jets which are generated by gas jet nozzles arranged in a row produce a delimited surface region on the bath surface, within which surface region the particles which are foreign to the melt are accumulated. FIG. 5 shows the bath surface 8 between two casting rolls 1, 2 and two side plates 3, 4. Above the bath surface 8, gas jet nozzles 16 are positioned parallel to the casting rolls and parallel to the side plates, generating targeted gas jets 20 directed toward the bath surface 8. They enclose a substantially rectangular delimited surface region 30 on the bath surface 8, in which the particles which are foreign to the melt accumulate.

Figure 6:
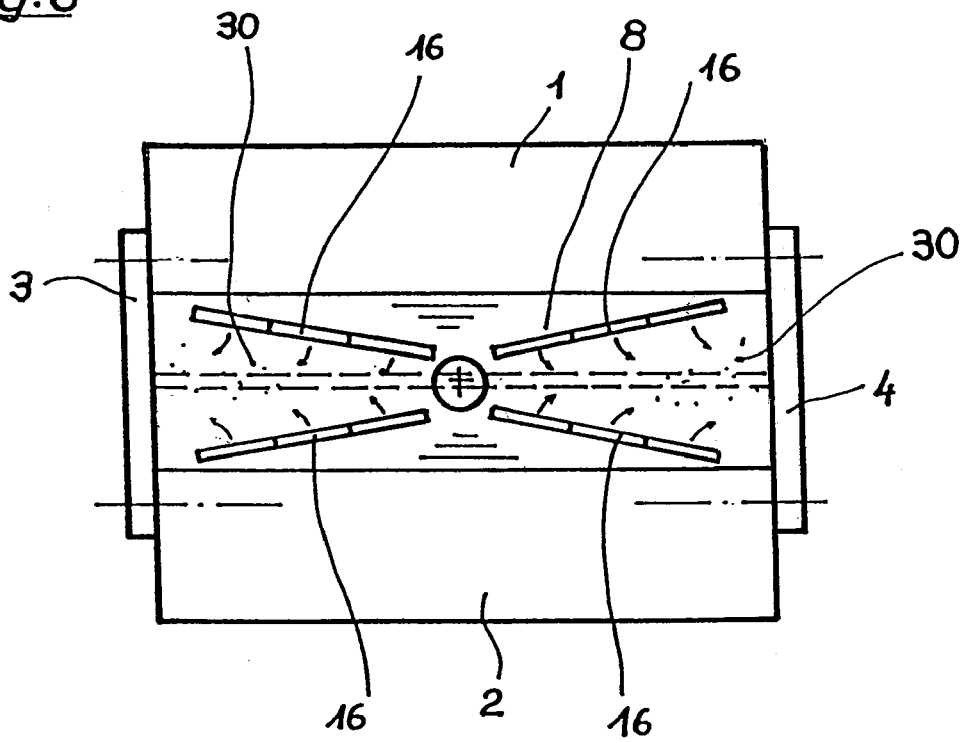
FIG. 6 shows the formation of a delimited surface region on the bath surface according to a further embodiment.

FIG. 6 illustrates a further advantageous embodiment for forming two delimited surface regions 30. In this case, gas jet nozzles 16 are oriented in an angular position with respect to the casting rolls 1, 2 and accordingly form a bow wave which is oriented obliquely with respect to the casting rolls. The submerged casting nozzle 6, which is centrally submerged in the melt bath, is included in the formation of the delimited surface region 30 and delimits this surface region in a subsection. In a further subsection, the two surface regions 30 are respectively delimited by the side plates 3, 4. The approximately V-shaped formation of the two delimited surface regions 30 allows the particular advantage of continuous discharge of particles which are foreign to the melt toward the side plates 3, 4 and therefore into the outermost edge regions of the cast steel strip.

Figure 6A:
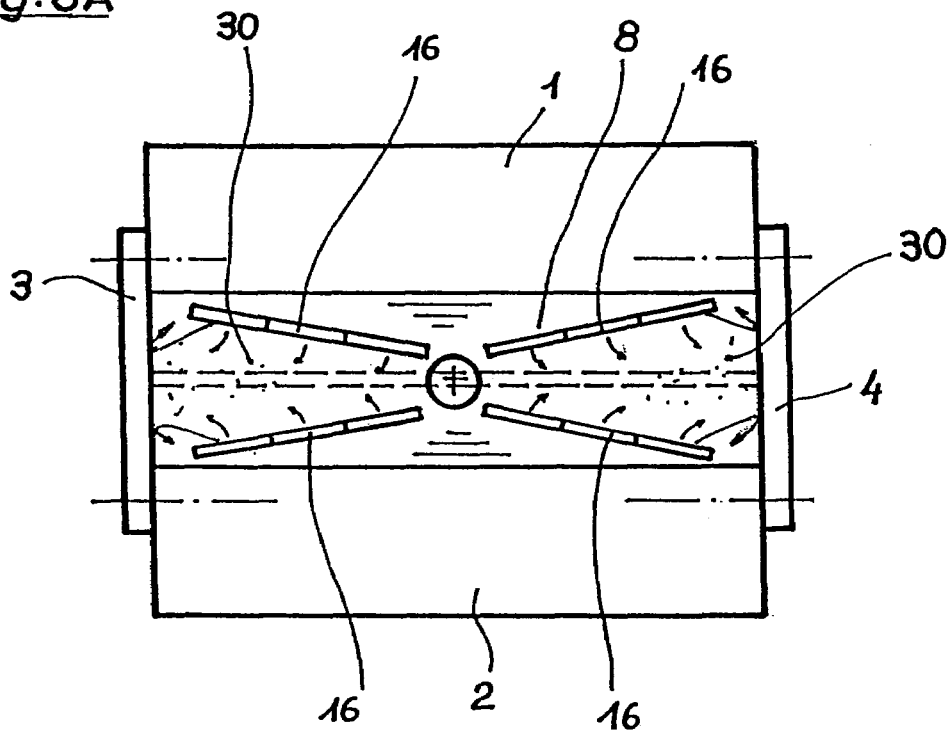
FIG. 6A shows an embodiment in which the delimited surface region is formed and in which gas jets strike surfaces of the side plates.

As illustrated in FIG. 6A, the gas jet nozzles 16 may be oriented such that the gas jets strike the surfaces of side plates 3, 4.

Figure 7:
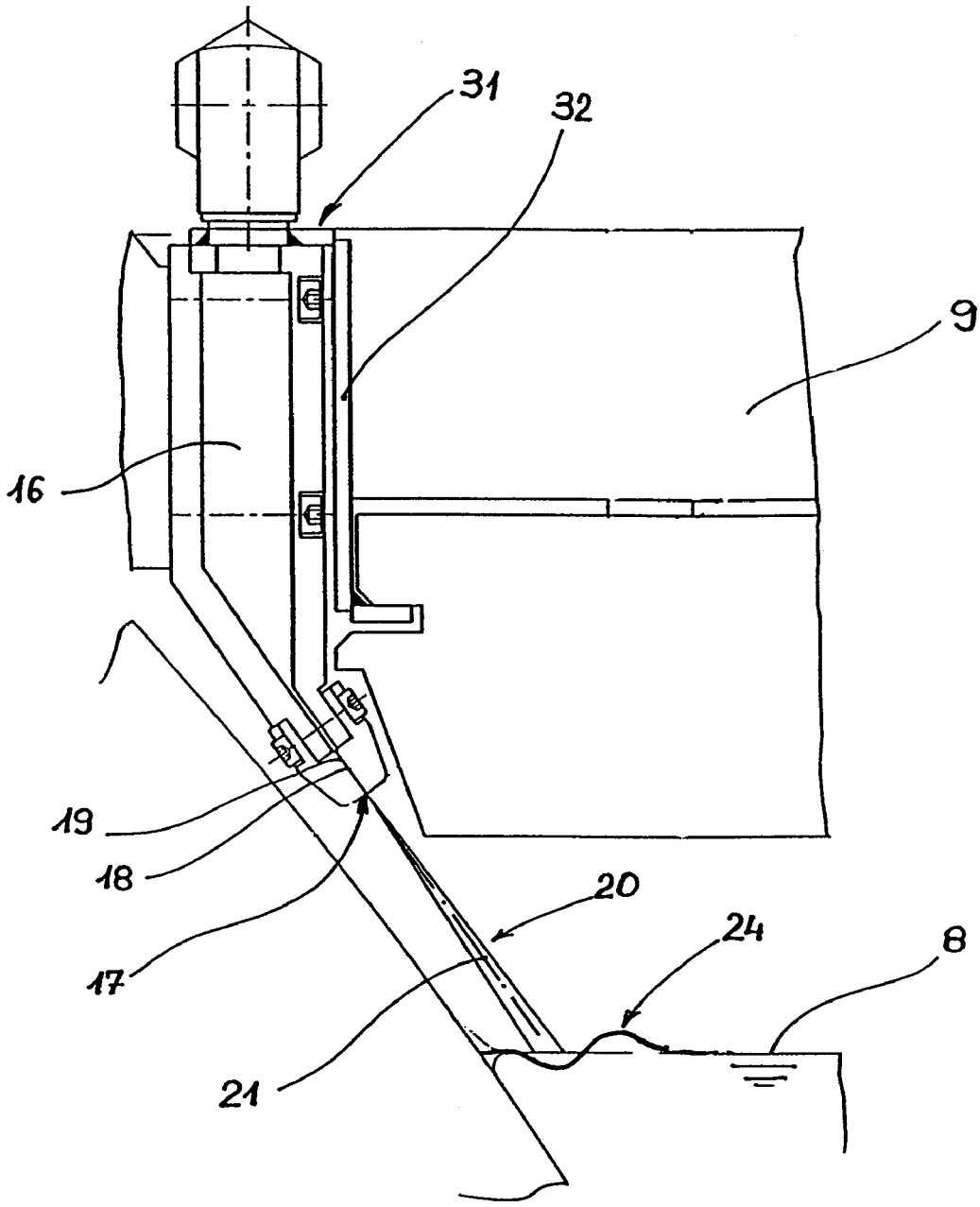
FIG. 7 shows the incorporation of the gas jet nozzles in the covering hood.

One possible embodiment for the incorporation of gas jet nozzles into the covering hood 9 which shields the melt bath from the ingress of external air is illustrated in FIG. 7. Between the casting rolls 1, 2 the covering hood 9 is positioned between the casting roll surfaces 14, 15, at a short distance therefrom, with supports (not illustrated in more detail) above the bath surface 8. The covering hood 9 is equipped with apertures or edge-side recesses, of which only one such passage 31, into which a gas jet nozzle 16 is fitted and screwed to a bracket 32 on the covering hood 9, is illustrated here. The gas jet nozzle 16 is designed as a slot nozzle or fan jet nozzle with a slot-shaped outlet opening 17 and has an outlet passage 19 which is straight at least in the end region. This produces a very narrow, focused gas jet 20 which is directed on to the bath surface 8 and forms the bow wave 24.

A further advantageous embodiment for forming a delimited surface region 25 is illustrated in FIG. 8. Gas jet nozzles 16 are arranged at a distance from the bath surface 8 and its edges toward the casting rolls 1, 2 and the side plates 3, 4 on all sides, with their outlet openings directed on to the bath surface. Two rows of gas jet nozzles 16*a*, 16*b*, . . . , which form gas jets 20*a*, 20*b*, . . . running parallel to one another and illustrated in FIG. 9, are oriented parallel to one another in a subsection along the delimited surface region along the longitudinal extent of the casting rolls. Gas jet nozzles with two outlet openings can also be used to the same effect. In both cases, a double bow wave is produced. FIG. 9 shows a gas jet nozzle 16 with two outlet openings 17*a*, 17*b* and with outlet passages 19*a*, 19*b* which diverge in the gas direction of flow. However, the outlet passages may also run parallel to one another. Two bow waves 24*a*, 24*b* are produced on the bath surface 8 at a distance from one another, thereby producing a double barrier to the particles which are foreign to the melt.

Figure 10:
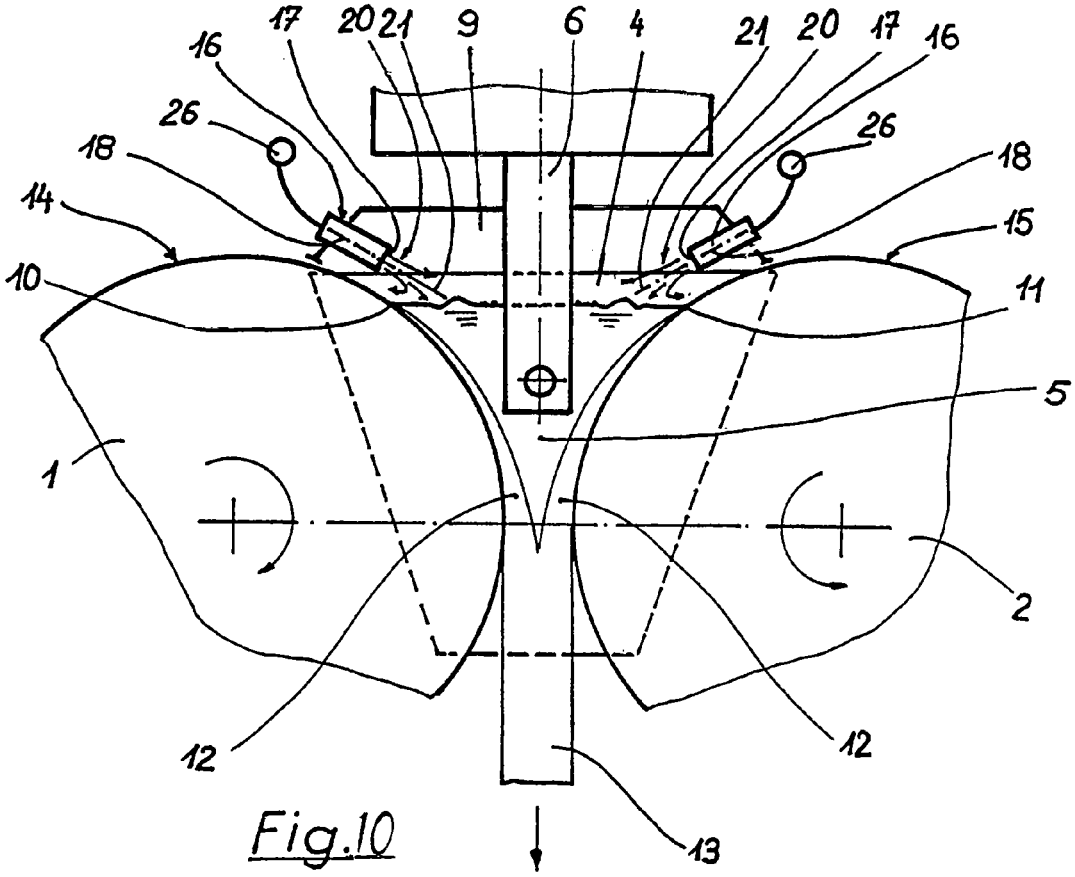
FIG. 10 illustrates an embodiment of the invention in which the gas jets strike the surface of the bath.

FIG. 10 illustrates that the gas jet nozzles 16 are arranged so that the gas jets strike the bath surface 8 but avoid directly striking the casting rolls 1, 2.

However, the invention is not restricted to the embodiments illustrated and described, but rather can be modified in numerous ways. It is also possible for gas jets which follow one another and form a delimited surface region, as well as the associated gas jet nozzles, to be arranged in such a way that the gas jets are directed directly toward the bath surface in one peripheral section of the delimited surface region and are directed on to the casting roll surface or the side plates in a further section.

The invention claimed is:

1. A method for producing a cast metal strip from a melt space fed by a metal melt, two opposing casting rolls and two side plates at opposite ends of the two opposing casting rolls together defining and enclosing the melt space and further defining a casting gap leading out of the melt space, the method comprising:

feeding the metal melt into the melt space for forming in the melt space a melt bath with a bath surface open on top, and delivering the cast metal strip out of the melt space through the casting gap;

forming a delimited surface region on the bath surface for collection of particles foreign to the metal melt being formed, the forming of the delimited surface region performed under an action of at least one gas jet directed onto the bath surface, the at least one gas jet having a jet axis that intersects the bath surface at a distance from a first contact line between the bath surface and one of the casting rolls, wherein an entirety of the at least one gas jet avoids directly striking the casting rolls and the at least one gas jet strikes the bath surface with the jet axis at the distance of from 10 mm to 50 mm, measured on the bath surface, from the first contact line.

2. The method as claimed in claim 1, further comprising directing the at least one gas jet toward the bath surface at an angle ($\alpha$) of from 25° to 145°.

3. The method as claimed in claim 1, further comprising directing the at least one gas jet onto the bath surface with the gas jet axis intersecting the bath surface at a distance from a second contact line between the bath surface and one of the two side plates.

4. The method as claimed in claim 3, wherein the distance from the second contact line is between 10 mm to 50 mm, measured on the bath surface.

5. The method as claimed in claim 3, further comprising directing the at least one gas jet onto a surface of one of the two side plates at a distance from the second contact line, and effectively diverting at least a part-stream of the gas jet onto the bath surface.

6. The method as claimed in claim 1, wherein the at least one gas jet comprises a fan jet.

7. The method as claimed in claim 6, wherein the at least one gas jet comprises a partially curved fan jet.

8. The method as claimed in claim 1, wherein the at least one gas jet diverges with an opening angle ($\gamma$) of between 10° and 35° in the direction of flow.

9. The method as claimed in claim 1, wherein between the two side plates, the at least one gas jet is directed to the bath surface parallel to or obliquely to the first contact line without interruption.

10. The method as claimed in claim 3, wherein between the two casting rolls, the at least one gas jet acts on the bath surface parallel to, without interruption, the second contact line between the bath surface and one of the two side plates.

11. The method as claimed in claim 1, wherein at least in sections, the at least one gas jet includes a first gas jet and a second gas jet, and the first gas jet acts on the bath surface at a distance from the second gas jet on the bath surface.

12. The method as claimed in claim 1, wherein the at least one gas jet is directed so as to form a bow wave at the bath surface, the bow wave being formed to enclose the delimited surface region at least in sections and the bow wave being kept constant at a height above the normal level of the bath surface.

13. The method as claimed in claim 1, wherein the at least one gas jet comprises an inert gas or a reducing gas, or a mixture comprising the inert gas and the reducing gas.

14. The method as claimed in claim 1, further comprising during a starting phase of the method, switching on the action of the at least one gas jet on the bath surface for 10 sec. to 2 min. after introduction of the metal melt into the melt space.

15. The method as claimed in claim 1, further comprising interrupting the action of the at least one gas jet on the bath surface in sections in a time interval during which particles foreign to the metal melt are discharged from a delimited surface region of the bath surface.

16. The method as claimed in claim 15, wherein the action of the at least one gas jet on the bath surface is interrupted along the first contact line.

17. The method as claimed in claim 15, further comprising directing the at least one gas jet onto the bath surface with the gas jet axis intersecting the bath surface at a distance from a second contact line between the bath surface and one of the two side plates, wherein the action of the at least one gas jet on the bath surface is interrupted along the second contact line.

18. The method as claimed in claim 15, further comprising removing particles foreign to the metal melt from the metal strip by trimming the edges of the cast metal strip after casting thereof.

19. The method as claimed in claim 15, further comprising removing particles foreign to the metal melt during a time interval immediately after a selected coil weight of the cast metal strip has been reached, and while this metal strip section which is enriched with particles foreign to the metal melt is being removed.

20. The method as claimed in claim 2, wherein the at least one gas jet is directed toward the bath surface at an angle ($\alpha$) of from 35° to 90°.

21. The method as claimed in claim 12, wherein the bow wave is at a height of from 0.05 mm to 10 mm.

22. The method as claimed in claim 12, wherein the bow wave is at a height of from 0.1 mm to 3 mm.

23. The method as claimed in claim 13, wherein the at least one gas jet comprises argon or nitrogen or $N+H_2$ or mixtures of at least two of the foregoing.

24. The method as claimed in claim 17, wherein the interruption is along contact lines between the bath surface and both of the two side plates.

25. A two-roll casting device for producing from a melt bath fed by a metal melt a cast metal strip comprising:

two opposing casting rolls driven in rotation, the two opposing casting rolls having opposite end sides;

side plates bearing against the end sides of the casting rolls;

the casting rolls and the side plates positioned and configured to define together and to enclose a melt space for holding therein the melt bath with a bath surface and also to define a casting gap;

at least one gas jet nozzle having an outlet opening and operable to provide a targeted gas jet, the nozzle being arranged in the melt space or being directed into the melt space such that a delimited surface region for collection of particles foreign to the metal melt is formed on the bath surface, the outlet opening of the at least one gas jet nozzle being directed onto the bath surface at a distance from a first contact line between the bath surface and one of the casting rolls, such that the gas jet strikes the bath surface, the gas jet having an axis and the gas jet axis being directed to provide a distance between the gas jet axis at the bath surface and the first contact line, wherein an entirety of the gas jet avoids directly striking the casting rolls and the at least one gas jet strikes the bath surface with the jet axis at the distance of from 10 mm to 50 mm, measured on the bath surface, from the first contact line.

26. The two-roll casting device as claimed in claim 25, wherein the outlet opening of the at least one gas jet nozzle is directed toward the bath surface at an inclined angle ($\alpha$).

27. The two-roll casting device as claimed in claim 25, wherein the outlet opening of the at least one gas jet nozzle is directed onto the bath surface at a distance from a second contact line between the bath surface and a side plate of the side plates.

28. The two-roll casting device as claimed in claim 27, wherein the distance between the gas jet axis directed onto the bath surface and the second contact line is in a range from 10 mm to 50 mm, measured on the bath surface.

29. The two-roll casting device as claimed in claim 25, wherein the outlet opening of the at least one gas jet nozzle is directed onto a side plate of the side plates at a distance from a second contact line between the bath surface and the side plate.

30. The two-roll casting device as claimed in claim 25, wherein between the side plates, the outlet opening of the at least one gas jet nozzle is directed onto the bath surface parallel to the first contact line.

31. The two-roll casting device as claimed in claim 25, wherein between the two opposing casting rolls, the outlet opening of the at least one gas jet nozzle is directed onto the bath surface parallel to a second contact line between the bath surface and a side plate of the side plates.

32. The two-roll casting device as claimed in claim 25, wherein the at least one gas jet nozzle comprises a fan jet nozzle with a slot-shaped outlet opening.

33. The two-roll casting device as claimed in claim 25, wherein the at least one gas jet nozzle includes two outlet openings for providing targeted gas jets, or two gas jet nozzles each having one outlet opening, such that the outlet openings are positioned and configured to form a double-delimited surface region for the collection of particles foreign to the metal melt on the bath surface.

34. The two-roll casting device as claimed in claim 25, wherein the outlet opening of the at least one gas jet nozzle is directed onto the bath surface such that it cooperates together with sections of the two opposing casting rolls or of the side plates within the melt space to form the delimited surface region on the bath surface under an action of the targeted gas jet.

35. The two-roll casting device as claimed in claim 25, further comprising a covering hood shaped and positioned such that the melt space formed by the casting rolls and the side plates is closed off with respect to ingress of air by the covering hood; and the outlet opening of the at least one gas jet nozzle opens out into the melt space.

36. The two-roll casting device as claimed in claim 35, wherein the at least one gas jet nozzle comprises a plurality gas jet nozzles secured to the covering hood and oriented thereby.

37. The two-roll casting device as claimed in claim 25, wherein the distance between the gas jet axis and the first contact line is in a range from 10 mm to 50 mm, measured on the bath surface.

38. The two-roll casting device as claimed in claim 26, wherein the angle $\alpha$ is from 25° to 140°.

39. The two-roll casting device as claimed in claim 26, wherein the angle $\alpha$ is from 35° to 90°.

* * * * *